US006814129B2

(12) United States Patent
Dupielet et al.

(10) Patent No.: US 6,814,129 B2
(45) Date of Patent: Nov. 9, 2004

(54) POWERED ROLLING SHUTTER EQUIPPED WITH AUTOMATIC STOPPING MEANS

(75) Inventors: Norbert Dupielet, Sallanches (FR); Alain Serasset, Sallanches (FR)

(73) Assignee: Somfy, Cluses (FR)

( * ) Notice: Subject to any disclaimer, the term of this patent is extended or adjusted under 35 U.S.C. 154(b) by 112 days.

(21) Appl. No.: 10/204,328

(22) PCT Filed: Feb. 19, 2001

(86) PCT No.: PCT/IB01/00221

§ 371 (c)(1),
(2), (4) Date: Aug. 19, 2002

(87) PCT Pub. No.: WO01/61139

PCT Pub. Date: Aug. 23, 2001

(65) Prior Publication Data

US 2003/0000657 A1 Jan. 2, 2003

(30) Foreign Application Priority Data

Feb. 21, 2000 (FR) ..... 00 02109

(51) Int. Cl.[7] ..... E06B 9/11
(52) U.S. Cl. ..... 160/310
(58) Field of Search ..... 160/310, 311, 160/188, 189, 1, 7

(56) References Cited

U.S. PATENT DOCUMENTS 4,059,339 A * 11/1977 Brown ..... 359/461
4,172,563 A * 10/1979 Werner et al. ..... 242/390.1
4,372,367 A * 2/1983 Baldanello et al. ..... 160/310
5,105,871 A 4/1992 Baud et al.
5,839,555 A * 11/1998 Hsieh ..... 192/223.1
6,305,457 B1 * 10/2001 Leivenzon et al. ..... 160/310
6,392,374 B1 5/2002 Menetrier et al.

FOREIGN PATENT DOCUMENTS

DE 197 06 209 A1 5/1998
EP 0 703 344 A1 3/1995
FR 2 740 824 5/1997

OTHER PUBLICATIONS

International Search Report PCT/IB01/00221.

* cited by examiner

*Primary Examiner*—David Purol
(74) *Attorney, Agent, or Firm*—Bugnion S.A.; John Moetteli

(57) ABSTRACT

The invention concerns a powered rolling shutter whereof the stator of the motor is connected to a fixed support via elastic means (R1, R2) for stopping the shutter in high and low abutment when the resisting torque exceeds a selected value, consisting of two springs (R1, R2) compressed by the stator rotation. The travel distance (12) before on of the springs (R2) is compressed is greater than the travel distance (11) before the other spring (R1) is compressed. The compression is ensured by a mobile element (12) also actuating a switch (18). The travels (c1, c2) required for activating the switch can be inverted. The motor can be mounted on the left or on the right with a differentiated resisting torque for stopping in high abutment and low abutment.

23 Claims, 9 Drawing Sheets

Fig.8
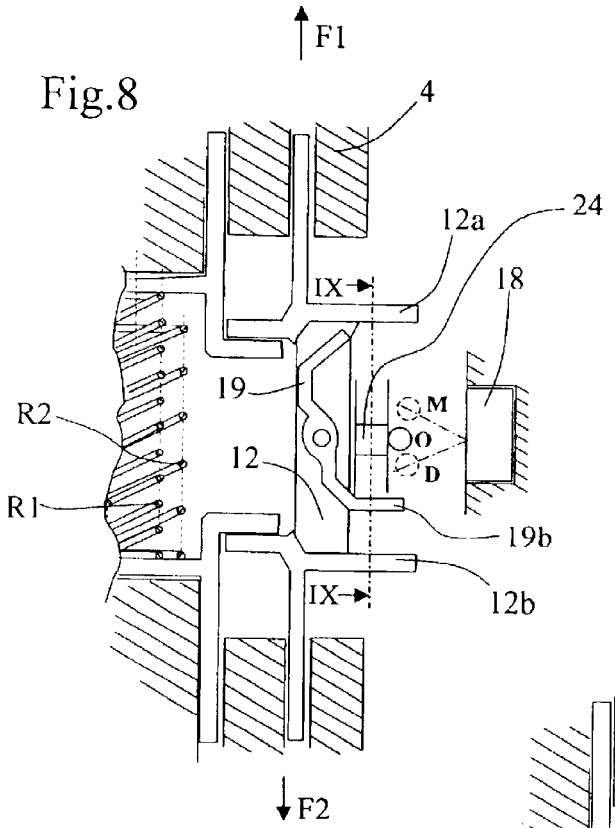
Fig.9
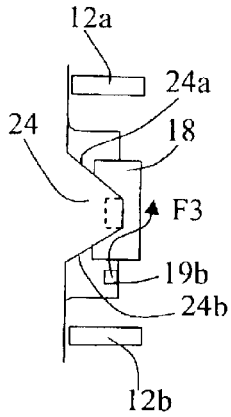
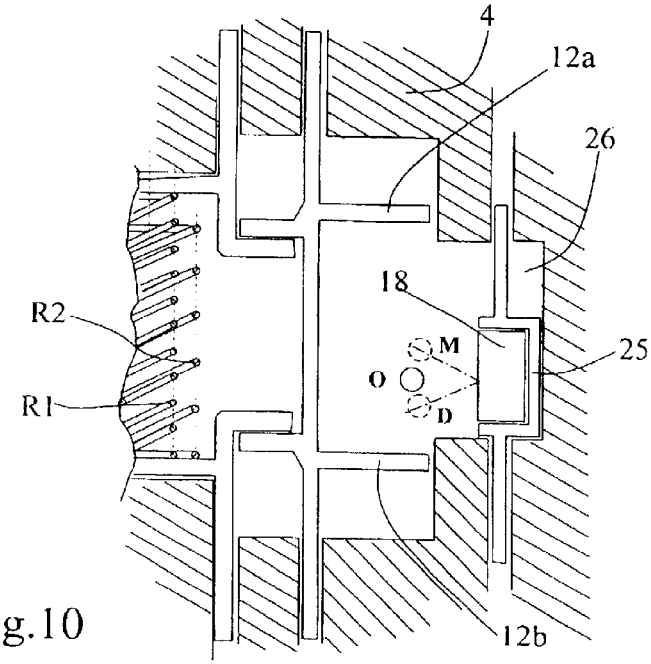
Fig.10

POWERED ROLLING SHUTTER EQUIPPED WITH AUTOMATIC STOPPING MEANS

BACKGROUND OF THE INVENTION

The invention relates to a motorized roller shutter or the like comprising an electric drive motor the stator of which is connected to a fixed support via elastic means which oppose the rotation of the stator under the effect of the resistive torque exerted by the roller shutter moving between a rolled up up position and an unrolled down position, stop means stopping the roller shutter in these up and down positions and means of controlling the stopping of the motor in these up and down positions comprising a switch the opening of which is actuated by the rotation of the stator when the resistive torque exceeds the retaining force exerted by the elastic means.

PRIOR ART

Roller shutters thus equipped are described in patents FR 2 740 824, the content of which is incorporated by reference, U.S. Pat. No. 6,392,374, the content of which is incorporated by reference, and EP 0 703 344, the content of which is incorporated by reference.

The roller shutter described in patent FR 2 740 824 uses a single spring. The switch is open when the roller shutter is in the unrolled position and the motor is powered via an auxiliary switch controlled by a revolutions counter associated with the motor. Such a roller shutter has to be mounted in a determined position in a window aperture.

The roller shutters described in patents U.S. Pat. No. 6,392,374 and EP 0 703 344 are equipped with two antagonist springs between which the stator of the motor is held. One of these springs is compressed when the roller shutter, completely rolled up, arrives at a top stop, while the other spring is compressed when the roller shutter, completely unrolled, has reached the bottom stop, generally against the bottom of the aperture. Now, as described in patent FR 2 740 824, the top stop spring has to be able to oppose the torque generated by the weight of the roller shutter. Now, when the shutter is almost completely unrolled, this weight may be very great. By contrast, the spring which controls the stopping of the motor when the roller shutter reaches the bottom stop has to give relatively readily in order to avoid needless compression of the shutter reaching the bottom stop, which compression could damage the shutter. It is therefore necessary to have two springs, one of them very strong, for the top stop, and the other far weaker, for the bottom stop. Now, by equipping the stopping device with two different springs, the direction of rotation of the motor corresponding respectively to the rolling-up and to the unrolling of the roller shutter, is determined, and this means that the motor has always to be arranged on the same side of the aperture, given that if the motor is arranged on the opposite side of the aperture its direction of rotation will have to be reversed, for the same position of the roller shutter, of course, which is generally the case. This represents a constraint that cannot always be satisfied and it is therefore necessary to have two motors with their stopping control device, one for mounting on the left and the other for mounting on the right of the aperture.

SUMMARY OF THE INVENTION

The object of the invention is to produce a roller shutter the motor and the stopping device of which can be mounted with equal ease on either side of the aperture. The stopping device has also to be compact so that it can be arranged inside a motor, particularly a tubular motor, without increasing the size thereof.

The roller shutter according to the invention is characterized in that the elastic means consist of two springs working in compression between two moving compression elements driven in turn by the stator respectively in each of the directions of rotation, the distance to be covered by the driven moving element, from the rest position, before one of the springs is compressed, exceeding the distance to be covered by the driven moving element before the other spring is compressed, and in that the stopping device comprises an actuating member kinematically linked to the stator and, on the one hand, driving the compression elements and, on the other hand, actuating the switch after a determined travel which differs for each direction of rotation of the stator and means of reversing the lengths of the travels.

When the stator rotates, just one spring is compressed first of all, this compression corresponding to the shortest travel of the actuating member, that is to say to the stopping of the motor when the roller shutter reaches the bottom stop. When the moving drive element moves in the opposite direction corresponding to its long travel, just one spring is compressed first of all, then both springs are compressed, offering significantly more resistance, this situation corresponding to the roller shutter arriving at the top stop. Actuation of the means of reversing the travel lengths makes it possible to obtain the same result when the motor is rotating in the opposite direction.

The distance to be covered by the driven moving element before one of the springs is compressed may be zero.

The springs are advantageously helical, with different diameters and nested coaxially one inside the other. Such a construction is particularly compact. To simplify the construction, the compression elements advantageously have a single distance between them and the springs are of different lengths.

The spring compressed second is advantageously pre-compressed at rest. Both springs may be pre-compressed. Pre-compressing the springs makes it possible to operate on a gentle slope with short travel, which allows better control over the forces developed by the springs and therefore makes it possible to enjoy great precision in the triggering forces, particularly in that of the spring which is compressed by itself which has not to be too high in order not to damage the roller shutter. Pre-compression also makes it possible to reduce the size of the stopping device.

The actuating member may be part of the stator.

According to one embodiment, the actuating member consists of a traveler guided in the support and equipped, on one side, with two arms for driving the compression elements in the compression direction and, on the other side, with two arms for actuating the switch which is mounted between these arms and the means of reversing the length of the travels consist of a rocker mounted between the actuating arms of the switch and equipped with two arms which act alternately as arm for actuating the switch depending on the position of the rocker, the other arm being retracted relative to the switch, the active arm being situated between one of the actuating arms of the traveler and the switch.

According to an improvement of this embodiment, the arms of the rocker are flexible in a direction parallel to its axis of pivoting and the stopping device comprises a fixed stop situated in the path of the arms of the rocker, facing the open position of the switch, this stop having the effect of moving the active actuating arm of the rocker away from its normal active path so as to make it inoperative. This improvement prevents the motor from being powered in the rolling-up direction if an attempt is made at raising the roller shutter by hand, for example in the event of an attempted break-in.

According to another embodiment, the switch is mounted between the arms of the traveler and can move in the same direction as the traveler, so as to be able to alter the distance separating it from each of the actuating arms of the traveler, that is to say the length of the travel needed to actuate it using the traveler in each of the directions of rotation of the stator.

According to one embodiment, the springs are mounted in a cage one of the ends of which has a lateral arm driven directly by the traveler, the compression element compressing the other ends of the springs consisting of a part in the form of a piston entering the cage and the strongest spring which is pre-compressed between the two ends of the cage.

BRIEF DESCRIPTION OF THE DRAWINGS

The appended drawing depicts, by way of example, some embodiments of the invention. To simplify, the cylindrical surfaces are depicted as straight, that is to say in development.

FIG. 8 illustrates an improvement to the embodiment depicted in FIG. 2.

FIG. 9 is a side view on IX—IX of FIG. 8.

FIG. 10 is a schematic view of a second embodiment.

DETAILED DESCRIPTION OF THE PREFERRED EMBODIMENT(S)

Figure 1:
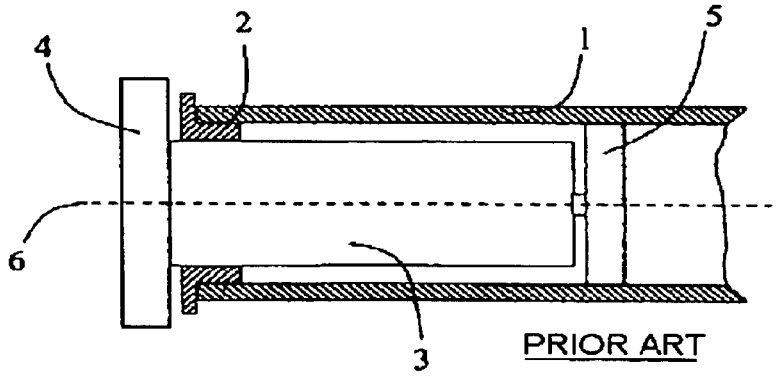
FIG. 1 depicts, as a reminder, a tubular motor driving a roller shutter winding tube.

FIG. 1 schematically depicts a well known way of driving a roller shutter, described for example in patent U.S. Pat. No. 5,105,871, the content of which is incorporated by reference. It is possible to discern a winding tube 1 about which a roller shutter is rolled up. This winding tube 1, depicted in part, is borne, on the side depicted, by an annulus 2 mounted to rotate on the cylindrical tubular casing 3 of an electric geared motor unit. The other end of the winding tube 1 is mounted so as to rotate on a support which has not been depicted. The casing 3 is mounted on a fixed support 4, for example, in the aperture of a window. Thus, mounted in the tubular casing 3 are an electric motor associated with reduction gearing the output of which drives an annulus 5 itself driving the rotation of the winding tube 1.

As is the case of the constructions described in patents FR 2 740 824 and U.S. Pat. No. 6,392,374, the casing 3 of the motor, and therefore the motor stator fixed to this casing, is connected elastically to the fixed support 4 in such a way as to be able to turn slightly about its axis denoted in FIG. 1 by the reference 6.

Figure 2:
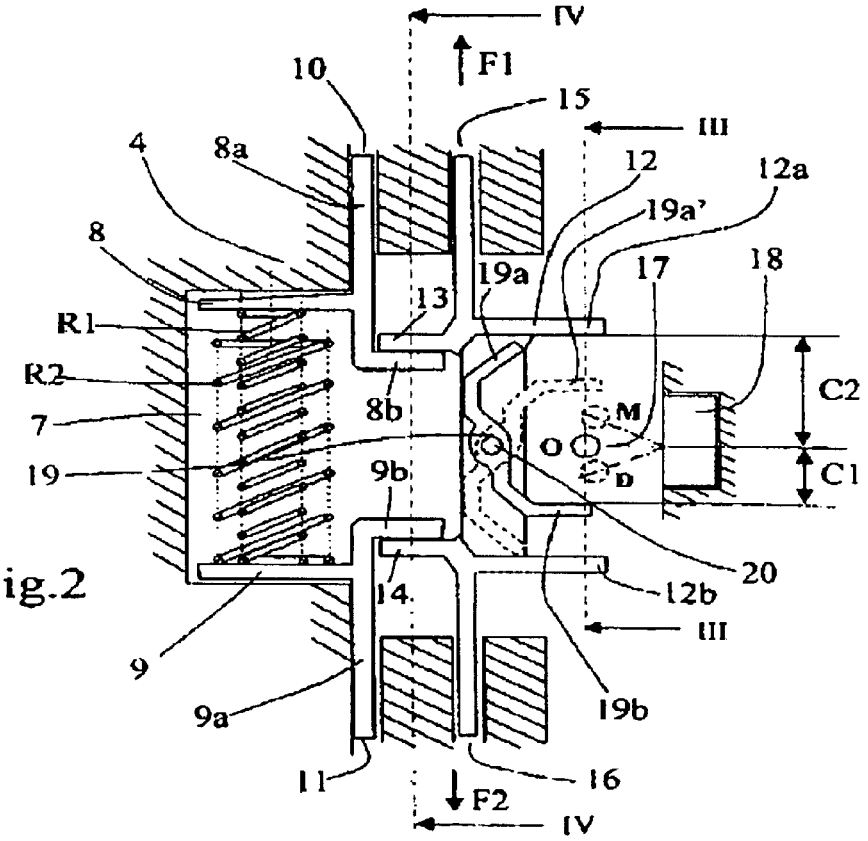
FIG. 2 is a schematic side view of a first embodiment of the stopping device.
Figure 4:
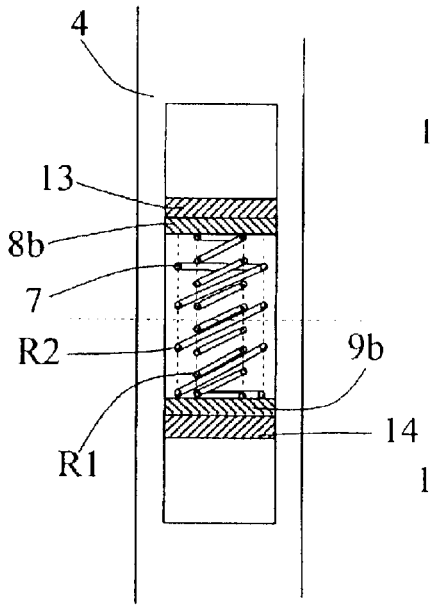
FIG. 4 is a view in section on IV—IV of FIG. 2.
Figure 3:
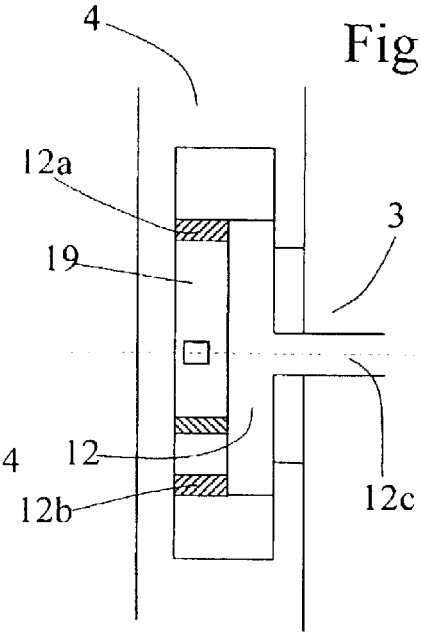
FIG. 3 is a view in section on III—III of FIG. 2.

This elastic connection is depicted in FIGS. 2 to 4. Mounted coaxially in a housing 7 of the fixed support 4 are two springs R1 and R2, the spring R1, longer than the spring R2 and of smaller diameter, being mounted inside the spring R2 which itself is substantially stronger than the spring R1. These springs R1 and R2 are mounted between two compression pieces 8 and 9 equipped, on the one hand, with a guiding arm 8*a* and 9*a* respectively which are mounted to slide freely in guide slots 10 and 11 of the fixed support 4. The compression pieces 8 and 9 are also equipped with a lateral arm 8*b*, 9*b* so that they can be driven by the arms 13 and 14 respectively of a traveler 12 which is secured to the casing 3 so as to rotate as one therewith by an arm 12*c* (FIG. 3) and guided in the fixed support 4 in guides 15 and 16 so as to move parallel to the springs R1, R2. This traveler 12 has two parallel arms 12*a* to 12*b* opposite the arms 13 and 14. Mounted between these arms 12*a* and 12*b* is the arm 17 of a reversing switch 18. The arm 17 can occupy three positions, a central position O in which the switch is open, a position M in which the motor is powered in the raising direction, that is to say in the direction for rolling up the roller shutter, and a position D in which the motor is powered in the down position, that is to say in the direction for unrolling the roller shutter. The traveler 12 bears a rocker 19 articulated about an axis 20 transversely to the traveler. This rocker 19 is equipped with two arms 19*a* and 19*b* which can be positioned, in turn, between the arms 12*a* and 12*b* of the traveler so that, in this position, the arm can actuate the switch when the traveler moves.

Figure 16:
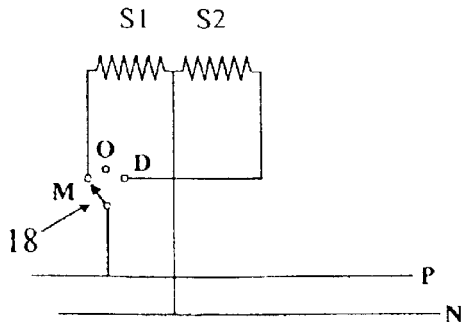
FIG. 16 depicts the electrical diagram for controlling the motor using an inverter.

The device is depicted in its rest position. It is assumed first of all that the roller shutter is completely rolled up. Unrolling is triggered by the switch being placed in the position D which has the effect of powering the winding S2 of the motor (FIG. 16). When the roller shutter comes against the bottom stop it exerts on the motor a resistive torque which has a tendency to drive the casing 3 and therefore the traveler 12, connected to the casing 3, in the direction of the arrow F1. The arm 14 of the traveler exerts thrust on the arm 9*b* of the compression piece 9. When the resistive torque is high enough to compress the spring R1, the traveler moves in the direction F1 and, after a certain travel, the arm 19*b* of the rocker meets the arm 17 of the switch. After a travel c1 this arm 17 is brought into the position O. The power supply to the motor is cut off.

The rolling-up of the roller shutter is brought about by placing the switch in the position M which has the effect of powering the winding S1 of the motor (FIG. 16). When the roller shutter reaches the top stop, it exerts on the motor a resistive torque which has the tendency to drive the traveler 12 in the direction of the arrow F2. This resistive torque is soon sufficient for the traveler 12 to drive the compression piece 8 via its arm 13, compressing the spring R1. The compression piece continuing to move then compresses the two springs R1 and R2, the switch 18 being brought into the position O only when the arm 12*a* of the traveler has covered the travel c2 which is substantially greater than the travel c1. In this case, the resistive torque needed to actuate the switch is therefore substantially higher than the resistive torque needed to stop the motor against the bottom stop.

If the motor 3 with its support 4 are mounted on the other side of the aperture, so that the direction of rotation of the motor for rolling up and unrolling is reversed, then the rocker 19 is rocked into the position shown in chain line and it is then the arm 19 in the position 19*a*′ which actuates the switch. The travels c1 and c2 are therefore reversed and the device for stopping the motor is thus adapted to the change in direction of rotation of the motor.

In FIG. 2, the spring R1 can be slightly pre-compressed. By contrast, the spring R2 is not pre-compressed at rest.

It is, however, more advantageous to work with two pre-compressed springs, as this makes it possible to use springs with a gentle slope and to operate linearly over short travels, which makes it possible to have better control over the forces developed by R1 and R2 and therefore makes it possible to enjoy great precision in the triggering forces, particularly in those of the spring R1 which has not to be too high in order not to damage the shutter.

Figure 5:
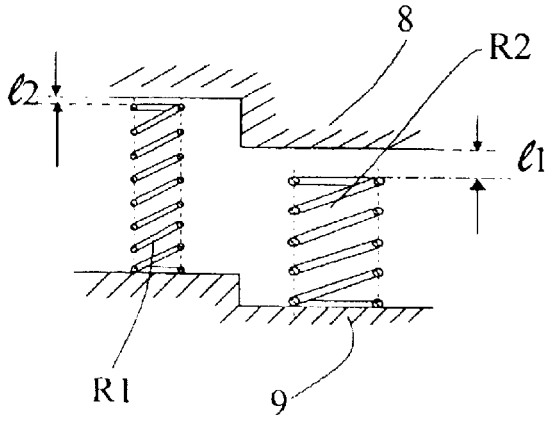
FIG. 5 schematically depicts the conditions to be met by the springs and the compression elements.

The different lengths and the different stiffnesses of the springs are not necessary conditions for obtaining the desired result. The springs could have the same stiffness. It would be sufficient for a travel c1 of the traveler for just one spring to be compressed and, for a longer travel c2, for both springs to be compressed. FIG. 5 illustrates these conditions for compression elements 8, 9 compressing two springs, here depicted in parallel. The distance between the compression elements for each of these springs is not necessarily the same. In general, for the spring R1 to be compressed by itself first of all, it is necessary and sufficient for 12 to be greater than 11, that is to say for the distance 12 to be covered by the driven compression element before it compresses R2 to be greater than the distance 11 to be covered by the compression element before it compresses R1.

Figure 6:
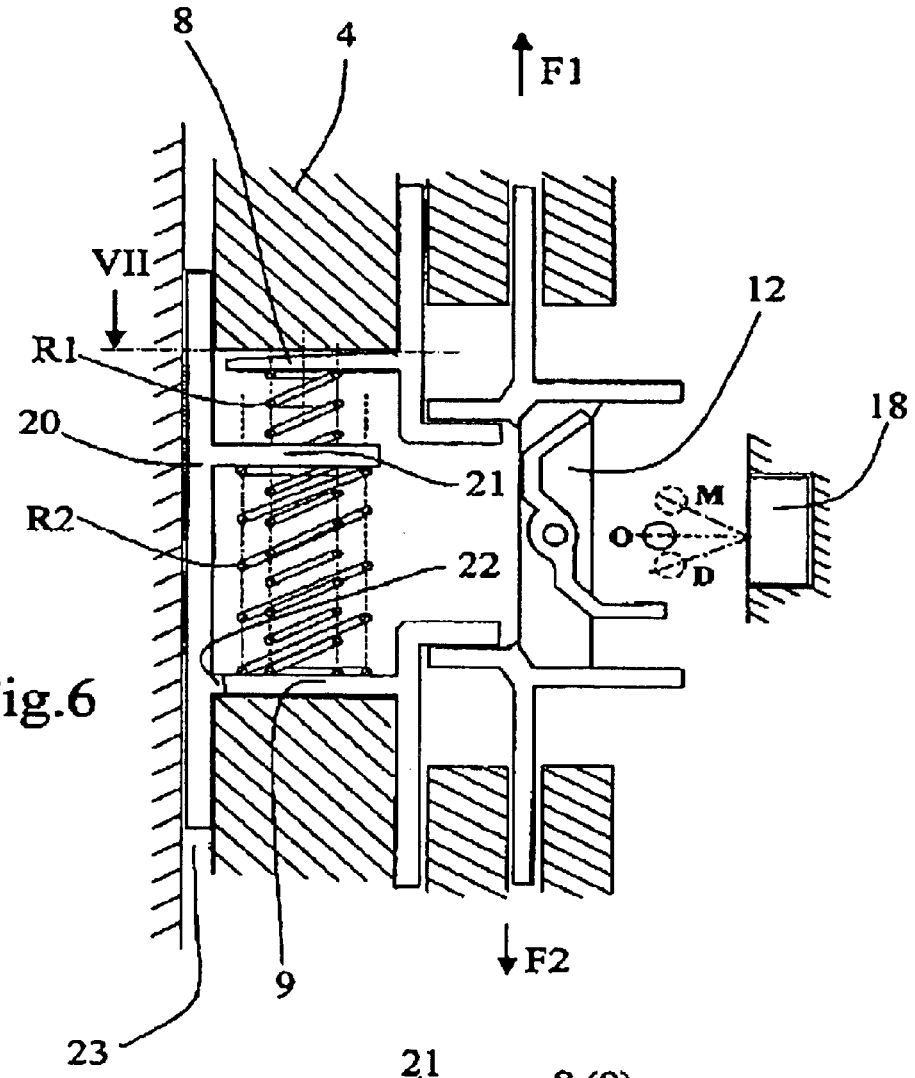
FIG. 6 schematically depicts an alternative form of embodiment of FIG. 2 in which the strongest spring is highly compressed.
Figure 7:
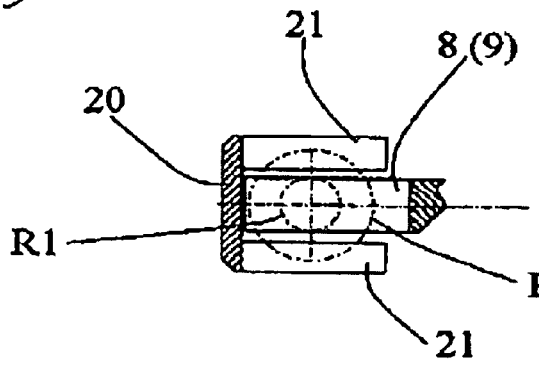
FIG. 7 is a part view in section on VII—VII.

In general, there will be 11=zero, that is to say that there is no dead travel. The spring R2 may be pre-compressed or not. FIG. 6 illustrates schematically an alternative form of embodiment of the embodiment depicted in FIG. 2, in which alternative form the two springs R1 and R2 are pre-compressed. The spring R1 is pre-compressed between the compression pieces 8 and 9. The spring R2 is pre-compressed in a cage 20, more specifically between two pairs of forks 21 and 22 of this moving cage which is guided in a guide 23 of the fixed support 4. These forks 21 and 22 allow the compression pieces 8 and 9 to pass. In the direction F1, the compression piece 9 can thus pass through the fork 22 to compress the spring R2 when the fork 21 comes into abutment and, conversely, the compression piece 8 can pass through the fork 21 to compress the spring R2.

FIGS. 8 and 9 schematically illustrate an improvement to the first embodiment or to its alternative, avoiding reapplication of power to the motor in the raising direction if, once the shutter has stopped in the down position, it is lifted up by hand by its last lath, for example during an attempted break-in. In this case, if FIG. 2 is considered, the thrust on the roller shutter exerts on the motor a torque in the direction of the arrow F1, that is to say a torque the direction of which is the same as the resistive torque which caused the motor to stop. The traveler 12 will therefore rock the switch into the position M which causes the rolling-up of the roller shutter. To prevent this, the traveler 12 is equipped with a rocker 19 the arms of which are flexible at least in a direction parallel to the axis of articulation of the rocker and fixed to the support 4 is a stop 24 which, on each side, has a ramp 24*a*, 24*b* and is placed, between the arms of the traveler 12, in the path of the active arm of the rocker 19, for example the arm 19*b*. The top of the stop 24 also faces the position O of the switch 18. When the roller shutter is unrolled in the down position and stopped, the switch 18 is in the position O. When the roller shutter is lifted up, the arm 19*b* of the rocker meets the ramp 24*b* which moves the arm away from its normal path as depicted by the arrow F3, so that it does not meet the arm 17 of the switch and so that the motor is not powered.

Reversing the lengths of travel c1 and c2 can also be obtained by moving the switch. This alternative is depicted in FIG. 10. The switch 18 is mounted in a moving support 25 which can be moved in a housing 26 of the fixed support 4. The moving support 25 is equipped with guide arms sliding in a guide of the fixed support 4. The moving support 25 is used in abutment against one or other of the ends of the housing 26.

Figure 11:
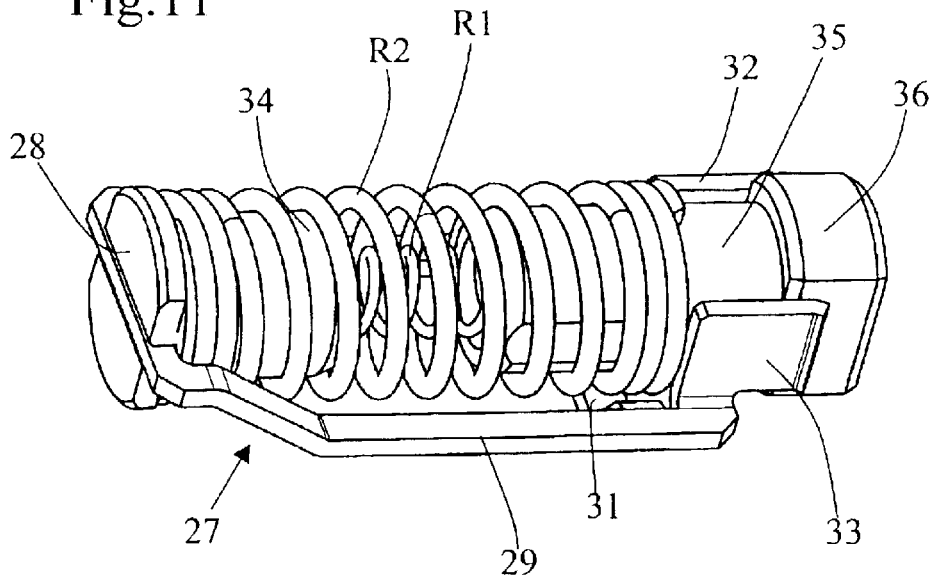
FIG. 11 is a perspective view of one embodiment of the spring cage.
Figure 12:
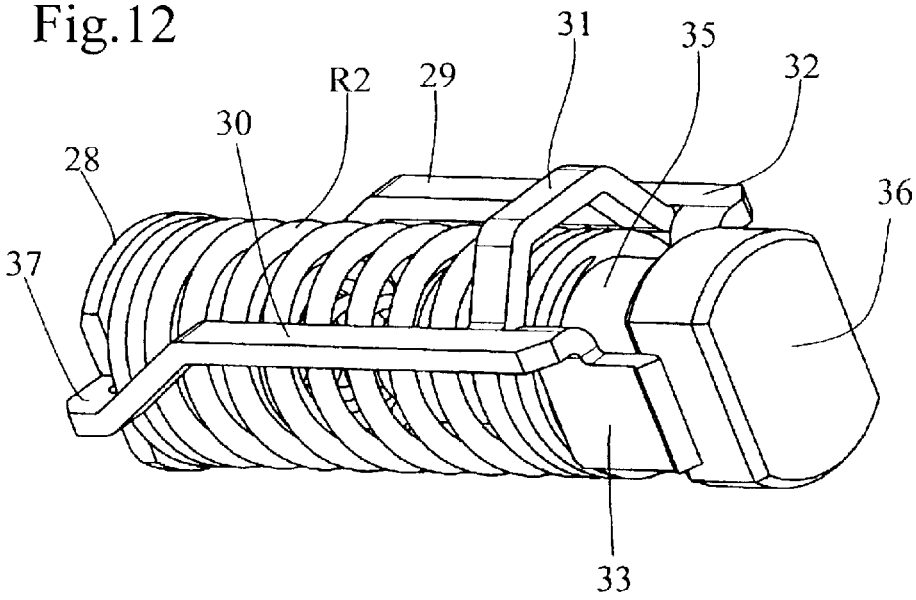
FIG. 12 is another perspective view of this cage.
Figure 13:
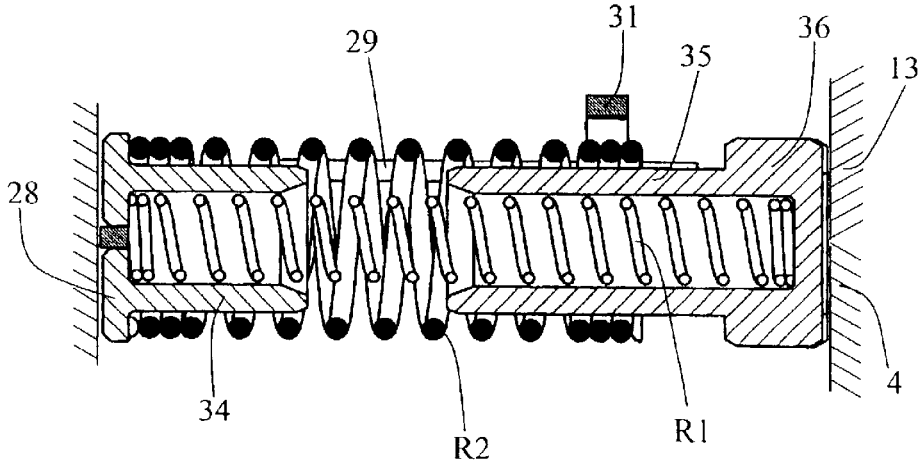
FIG. 13 is a view in axial section of the cage depicted in FIGS. 11 and 12.

One practical embodiment of the part of the stopping device concerning the springs R1 and R2 is depicted in FIGS. 11 to 13.

The springs R1 and R2 are mounted in a cage 27 consisting of a transverse wall 28 forming the end of the cage and of two arms 29 and 30 extending from the wall 28 parallel to the axis of the springs and connected, near their ends, by a bow 31. The ends of the arms 29 and 30 end in two walls 32 and 33 which are mutually parallel and parallel to the axis of the springs. The spring R2 is pre-compressed between the end 28 of the cage and the edge of the walls 32 and 33. Also extending from the end 28 is a tubular part 34 surrounded by the spring R2. This tubular part serves to guide the spring R1 engaged freely in this part 34 so as to press against the end 28. At the end 28, the arm 30 of the cage is bent twice at right angles to form a radial tab 37 by which the traveler 12 can drive the cage.

Also engaged in the spring R2 is a part 35 in the form of a hollow piston, at the end of which the other end of the spring R1 rests. This part 35 has a head 36 of a diameter that exceeds the body of the piston 35 but which is cut with two parallel flats so that the head 36 can pass between the walls 32 and 33 of the cage. The head 36 can therefore compress the spring R2.

Figure 14:
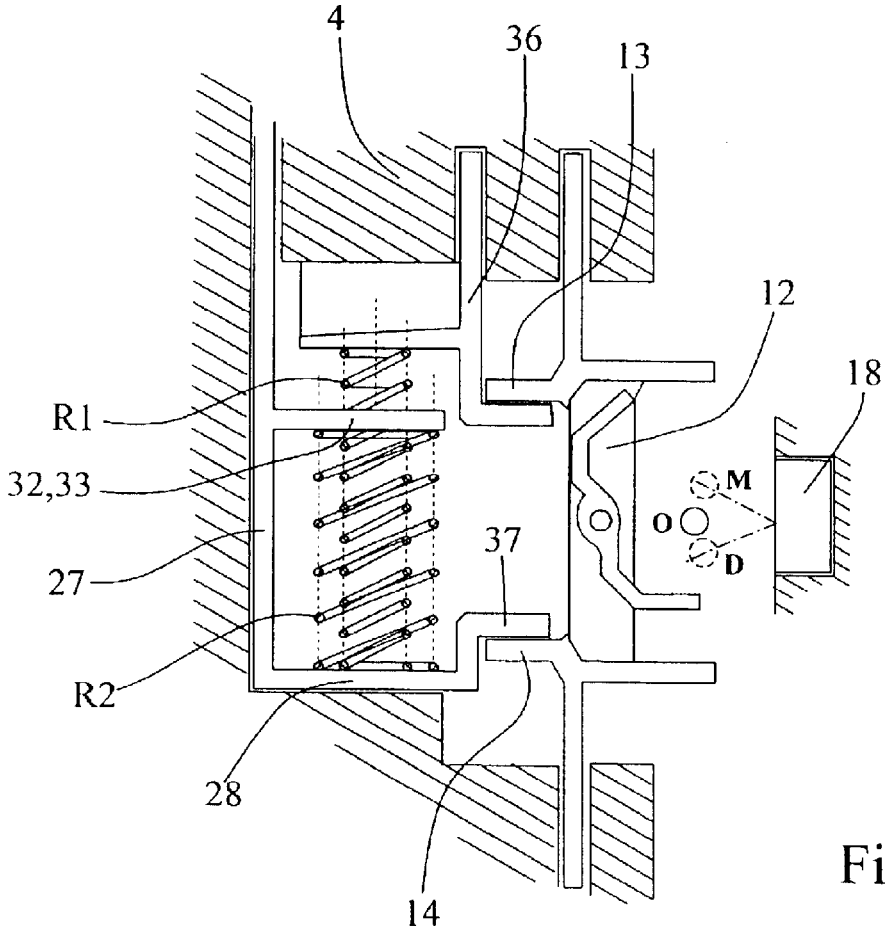
FIG. 14 is a schematic view similar to FIG. 2 but in which a cage according to FIGS. 11 to 13 is mounted.

The use of the cage depicted in FIGS. 11 to 13 in a stopping device according to FIG. 2 is depicted schematically in FIG. 14. The arm 13 of the traveler 12 rests directly on the head 36 of the piston 35 which piston, at rest, also rests against the fixed support 4. The radial arm 34 can be driven by the arm 14 of the traveler. The arm 29 of the cage 27 is used for guiding the cage, that is to say for preventing it from rotating about its axis. To this end, the arm 29 is engaged in a guide slot. At rest, the spring R1 is also pre-compressed. The piston 35 thus has to be kept pushed slightly into the cage 27 in order to mount this cage in the fixed support 4. In this case, the compression pieces 8 and 9 consist respectively of the head 36 of the piston and of the end 28 of the cage 27.

Apart from these few embodiment differences, the way in which the device works is the same as in the case of the device depicted in FIG. 6.

Figure 15:
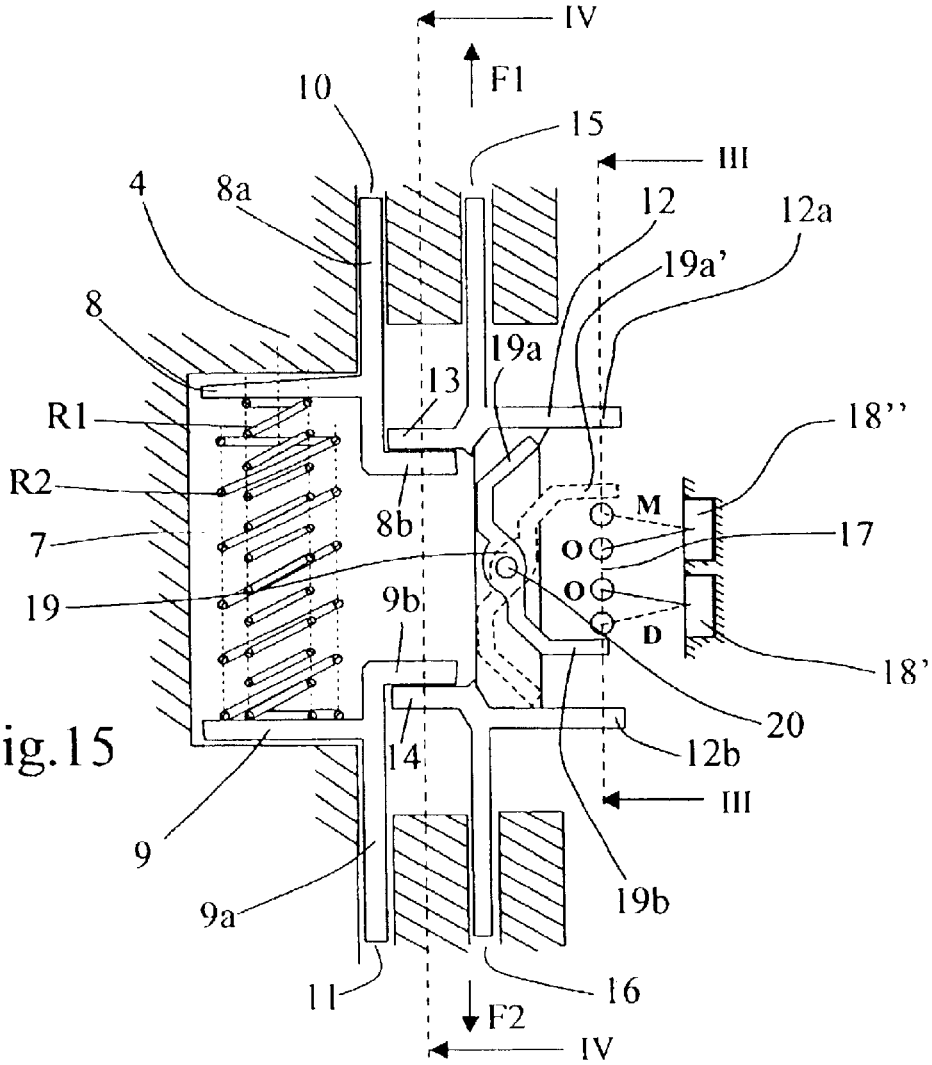
FIG. 15 illustrates an alternative form of the embodiment depicted in FIG. 2, in which the inverter is replaced by two bistable switches.

In the devices depicted in FIGS. 2, 6 and 8 to 10, it is possible to replace the reverser 18 with a pair of switches. By way of example, FIG. 15 depicts a modification to FIG. 2 in which up and down stoppage is provided by two bistable switches 18' and 18". The switch 18' controls stopping in the down direction. It is depicted in the closed position. The switch 18" controls stopping in the up direction. It is depicted in the open position.

Figure 17:
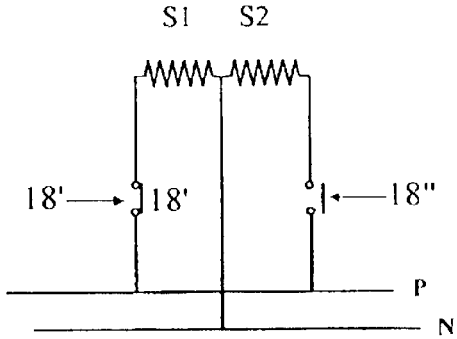
FIG. 17 depicts the electrical diagram for controlling the motor using two bistable switches.

The device is depicted in its position of rest as in FIG. 2. It is assumed that the shutter is completely rolled up. Unrolling is triggered by action on the switch 18' placed in the down position D (FIG. 17). The device works in the same way as the device according to FIG. 2. To raise the shutter, the switch 18" is placed in the up position M.

Instead of bistable switches it is possible to use monostable switches by adapting the control circuit.

Figure 18:
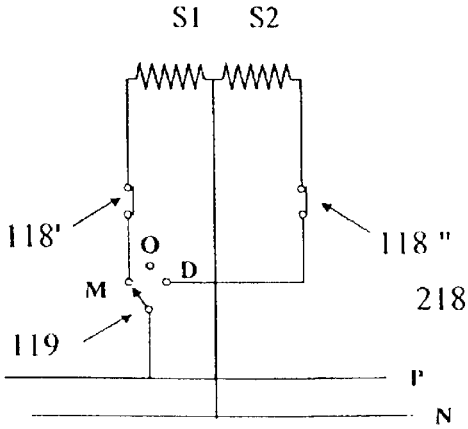
FIG. 18 depicts the electrical diagram of a first alternative form with two monostable switches, which is applied to a conventional diagram comprising an additional control contact switch.

In the diagram depicted in FIG. 18, use is made of two monostable switches 118' and 118", which are closed in the rest position, in conjunction with a control switch 119. The switches 118' and 118" correspond to the circuit breakers in a conventional diagram.

Figure 19:
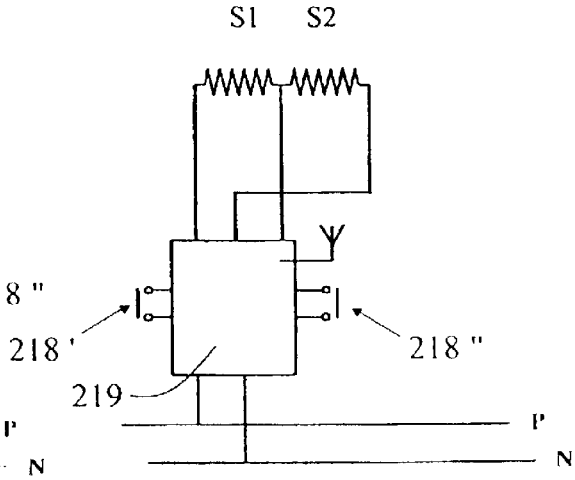
FIG. 19 depicts the electrical diagram of a second alternative form with two monostable switches controlling a control contact switch contained in a radio receiver.

In the diagram depicted in FIG. 19, the bistable switches 218' and 218" are open in the rest position. They control a control contact switch of the installation which is contained in a radio receiver 219. The contact switch can also therefore be controlled by a transmitter.

Although illustrative embodiments of the invention have been shown and described, a wide range of modification, change and substitution is contemplated in the foregoing disclosure and in some instances, some features of the present invention may be employed without a corresponding use of the other features. Accordingly, it is appropriate that the appended claims be construed broadly and in a manner consistent with the scope of the invention.

What is claimed is:

1. A motorized roller shutter comprising:

(a) an electric drive motor, having a stator connected to a fixed support via an elastic device which exert a retaining force and oppose the rotation of the stator imparted by a torque resistive to movement of the roller shutter between a rolled-up, up position and an unrolled, down position, (b) a stopping device stopping the roller shutter in the rolled-up and unrolled positions; and (c) means for controlling the stopping of the motor in the rolled-up and unrolled positions comprising at least one switch, actuated by the rotation of the stator which takes place when the resistive torque exceeds a retaining torque exerted by the elastic device, characterized in that:

(i) the elastic device comprises two springs working in compression between two moving compression elements driven in turn by an element of the stator which acts on the compression elements as the stator rotates in each rotational directions, (ii) the distance from a rest position to be covered by the compression element being driven before one of the springs is compressed, exceeds the distance to be covered by the compression element being driven before the other spring is compressed, and (iii) the stopping device comprises a moving actuating part mechanically linked to the stator, the moving actuating part drives the compression elements and actuates the switch after a predetermined amount of travel, the amount of travel differing for each direction of rotation of the stator and means for reversing said amount of travel.

2. The roller shutter as claimed in claim 1, characterized in that the springs are coaxially mounted one inside the other.

3. The roller shutters as claimed in claim 2, characterized in that at least a spring for which the distance to be covered by the compression element is the longest, is pre-loaded at rest.

4. The roller shutter as claimed in claim 2, characterized in that (a) the moving actuating part comprises a traveler guided in the fixed support and having, on one side, two arms for driving the compression elements in a compression direction and, on the other side, two arms for actuating the switch and (b) the means for reversing the travel comprises a rocker mounted between actuating arms of the traveler and having two arms which act, depending on rocker position, alternately as an arm for actuating the switch, the other arm being retracted relative to the switch, the arm being activated situated between one of the actuating arms of the traveler and the switch.

5. The shutter as claimed in claim 4, characterized in that (a) the arms of the rocker are flexible in a direction perpendicular to its pivoting axis and (b) the stopping device comprises a fixed stop disposed along the path of the arms of the rocker, facing an open position of the switch, this stop displacing the active actuating arm of the rocker out of its active path so as to make it inoperative.

6. The roller shutter as claimed in claim 2, characterized in that (a) the moving actuating part comprises a traveler guided in the fixed support and having, on one side, with two arms for driving the compression elements in compression and, on the other side, two arms for actuating the switch and (b) the switch is mounted on a support, the support moving in the same direction as the traveler, between two adjustable working positions, so as to be able to alter the distance separating the switch from each of the actuating arms of the traveler, so as to modify the length of the travel needed to actuate the switch using the traveler in each of the directions of rotation of the stator.

7. The roller shutter as claimed in claim 4, characterized in that the two springs are pre-loaded and in that the springs are mounted in a cage which is open on at least one side for the passage of the compression elements and has two rests between which one of the springs is compressed, the other spring being pre-loaded between the compression elements.

8. The roller shutter as claimed in claim 4, characterized in that the two springs are mounted coaxially in a cage which has, at one of its ends, a transverse wall against which one of the ends of the two springs bears and, at its other end, a rest for one of the springs pre-loaded between said wall and this rest, one of the compression elements comprising a radial arm of the cage, the other compression element comprising a piston sliding axially in the cage and in the pre-loaded spring and against which the other end of the other spring rests, the piston having a head which compresses the spring as it enters the cage.

9. The roller shutter as claimed in claim 8, characterized in that the cage is further formed of two arms extending from the transverse wall parallel to a long axis of the springs and connected by at least one bow.

10. The roller shutter as claimed in claim 9, characterized in that one of the arms of the case acts as a member for guiding the cage.

11. The roller shutter as claimed in claim 1, characterized in that the distance between the spring supports on the moving compression elements is the same and that the two springs have different lengths.

12. The roller shutter as claimed in claim 11, characterized in that the springs have different stiffnesses.

13. The roller shutter as claimed in claim 1, characterized in that the switch of the control means comprises an inverter.

14. The roller shutter as claimed in claim 1, characterized in that the control means comprises two bistable switches one assigned to each of the directions of rotation of the motor.

15. The roller shutter as claimed in claim 1, characterized in that the control means comprises two monostable switches.

16. The roller shutter as claimed in claim 15, characterized in that the monostable switches are circuit breakers.

17. The roller shutter as claimed in claim 15, characterized in that the monostable switches are open in the rest position and in radio communication with a receiver.

18. The roller shutter as claimed in claim 3, characterized in that (a) the moving actuating part comprises a traveler guided in the fixed support the traveler having, on one side, with two arms for driving the compression elements in the compression direction and, on the other side, two arms for actuating the switch which is mounted between these arms and (b) the means of reversing travel comprise a rocker mounted between the actuating arms of the traveler and having two arms which act, depending on rocker position, alternately as an arm for actuating the switch, the other arm being retracted relative to the switch, the active arm being situated between one of the actuating arms of the traveler and the switch.

19. The roller shutter as claimed in claim 3, characterized in that (a) the moving actuating part comprises a traveler guided in the fixed support the traveler having, on one side, two arms for driving the compression elements in the compression direction and, on the other side, two arms for actuating the switch which is mounted between these arms and (b) the switch is mounted on a support that can move in the same direction as the traveler, between two working positions, so as to be able to alter the distance separating the switch from each of the actuating arms of the traveler, so as to modify the length of the travel needed to actuate it using the traveler in each of the directions of rotation of the stator.

20. The roller shutter as claimed in claim 5, characterized in that the two springs are pre-loaded and in that the springs are mounted in a cage which is open on at least one side for the passage of the compression elements and has two rests between which one of the springs is compressed, the other spring being pre-loaded between the compression elements.

21. The roller shutter as claimed in claim 6, characterized in that (a) the two springs are pre-loaded and (b) the springs are mounted in a cage which is open on at least one side for the passage of the compression elements and has two rests between which one of the springs is compressed, the other spring being pre-loaded between the compression elements.

22. The roller shutter as claimed in one of claim 5, characterized in that the two springs are mounted coaxially in a cage which has, at one of its ends, a transverse wall against which one of the ends of the two springs bears and, at its other end, a rest for one of the springs pre-loaded between said wall and this rest, one of the compression elements comprising a radial arm of the cage, the other compression element comprising a piston sliding axially in the cage and in the pre-loaded spring and against which the other end of the other spring rests, the piston having a head which compresses the spring as it enters the cage.

23. The roller shutter as claimed in claim 6, characterized in that the two springs are mounted coaxially in a cage which has, at one of its ends, a transverse wall against which one of the ends of the two springs bears and, at its other end, a rest for one of the springs pre-loaded between said wall and this rest, one of the compression elements comprising of a radial arm of the cage, the other compression element comprising a piston sliding axially in the cage and in the pre-loaded spring and against which of the other spring rests, the piston having a head which compresses the spring as it enters the cage.

* * * * *